US011565159B2

(12) United States Patent
Gonzalez

(10) Patent No.: US 11,565,159 B2
(45) Date of Patent: Jan. 31, 2023

(54) GOLF CLUB HEAD COVER

(71) Applicant: Victor Manuel Gonzalez, Camas, WA (US)

(72) Inventor: Victor Manuel Gonzalez, Camas, WA (US)

(73) Assignee: Victor Manuel Gonzalez, Camas, WA (US)

( * ) Notice: Subject to any disclaimer, the term of this patent is extended or adjusted under 35 U.S.C. 154(b) by 167 days.

(21) Appl. No.: 16/782,583

(22) Filed: Feb. 5, 2020

(65) Prior Publication Data

US 2020/0188752 A1 Jun. 18, 2020

Related U.S. Application Data

(63) Continuation-in-part of application No. 16/438,184, filed on Jun. 11, 2019, now abandoned.

(60) Provisional application No. 62/695,360, filed on Jul. 9, 2018.

(51) Int. Cl.

| | |
|---|---|
| ***A63B 57/00*** | (2015.01) |
| ***A63B 60/62*** | (2015.01) |
| ***A63B 57/20*** | (2015.01) |

(52) U.S. Cl.

CPC ..... *A63B 60/62* (2015.10); *A63B 57/20* (2015.10); *A63B 2209/00* (2013.01)

(58) Field of Classification Search

CPC ..... A63B 60/62; A63B 57/20; A63B 2209/00

See application file for complete search history.

(56) References Cited

U.S. PATENT DOCUMENTS

| | | | | |
|---|---|---|---|---|
| 1,452,679 | A | 4/1923 | Fisher | |
| 5,094,283 | A * | 3/1992 | Lawrence | A63B 60/62 150/160 |
| 6,571,947 | B1 * | 6/2003 | Rogers | A63B 55/40 206/315.2 |
| D544,556 | S * | 6/2007 | Old | A63B 60/62 D21/754 |
| 7,905,349 | B2 | 3/2011 | Campbell | |
| 2002/0108689 | A1 * | 8/2002 | Kloos | A63B 57/50 150/160 |
| 2004/0206431 | A1 | 10/2004 | Metzig et al. | |
| 2004/0206433 | A1 * | 10/2004 | Kim | A63B 60/62 150/160 |
| 2007/0235115 | A1 * | 10/2007 | Stevens | A63B 60/62 150/160 |
| 2008/0023115 | A1 | 1/2008 | Wu | |
| 2008/0178979 | A1 | 7/2008 | Wu | |
| 2014/0349785 | A1 | 11/2014 | Henning | |
| 2015/0352409 | A1 * | 12/2015 | Darr | A63B 71/0036 206/315.9 |

(Continued)

OTHER PUBLICATIONS

International Search Report and Written Opinion, dated Sep. 5, 2019 in International Patent Application No. PCT/US2019/036613.

*Primary Examiner* — Raleigh W Chiu

(74) *Attorney, Agent, or Firm* — Veros Legal Solutions, LLP

(57) ABSTRACT

There is provided a golf club head cover with golf ball holders on the outside comprising of a golf club head cover, golf ball holders attached to the outside of the golf club head cover and fasteners that attach the golf ball holders to the golf club head cover. The golf ball holders may form an animal or character feature such as an eye.

8 Claims, 14 Drawing Sheets

(56) References Cited

U.S. PATENT DOCUMENTS

| | | | | |
|---|---|---|---|---|
| 2020/0009435 | A1* | 1/2020 | Gonzalez | A63B 60/62 |
| 2020/0188752 | A1* | 6/2020 | Gonzalez | A63B 57/20 |

* cited by examiner

GOLF CLUB HEAD COVER

RELATED APPLICATIONS

This application is a continuation-in-part of U.S. patent application Ser. No. 16/438,184, filed on Jun. 11, 2019 and entitled GOLF CLUB HEAD COVER, which application claims priority to U.S. Provisional Application 62/695,360 filed on Jul. 9, 2018, also entitled GOLF CLUB HEAD COVER. The entire disclosures of all the related applications set forth in this section are hereby incorporated by reference in their entireties.

BACKGROUND

This application pertains to the field of golf.

For years, golf club head covers have been used to protect golf clubs from damage or from elements of the environment. Golf club head covers protect the clubs from collisions that would create damaging marks, dents, or scuffs to the golf clubs. The golf club head covers give the golf clubs a protective barrier. Golf club head covers also protect the golf club from the elements such as rain, snow and dust. Rain can contribute to the corrosion of a golf club During a game of golf, the golfer can lose a golf ball by hitting the ball in the woods or in the water. The golfer must then find another golf ball to play with. Typically, golf balls are kept in zipped compartments on the side of the golf bag. Losing a golf ball can be a stressful time for a golfer and finding a golf ball to replace the lost ball can add to the stress.

Current commercially available golf club head covers don't have a location to store golf balls. If a golfer loses a golf ball while playing, they have to find a new golf ball. Typically, that new golf ball is found in one of the compartments on the side of the golf bag.

It should be noted that this Background is not intended to be an aid in determining the scope of the claimed subject matter nor be viewed as limiting the claimed subject matter to implementations that solve any or all of the disadvantages or problems presented above. The discussion of any technology, documents, or references in this Background section should not be interpreted as an admission that the material described is prior art to any of the subject matter claimed herein.

SUMMARY

There is provided a golf club head cover with golf ball holders on the outside comprising of a golf club head cover, golf ball holders attached to the outside of the golf club head cover and fasteners that attach the golf ball holders to the golf club head cover.

It is understood that various configurations of the subject technology will become apparent to those skilled in the art from the disclosure, wherein various configurations of the subject technology are shown and described by way of illustration. As will be realized, the subject technology is capable of other and different configurations and its several details are capable of modification in various other respects, all without departing from the scope of the subject technology. Accordingly, the summary, drawings and detailed description are to be regarded as illustrative in nature and not as restrictive.

BRIEF DESCRIPTION OF THE DRAWINGS

Various embodiments are discussed in detail in conjunction with the Figures described below, with an emphasis on highlighting the advantageous features. These embodiments are for illustrative purposes only and any scale that may be illustrated therein does not limit the scope of the technology disclosed. These drawings include the following figures, in which like numerals indicate like parts.

DETAILED DESCRIPTION

The following description and examples illustrate some exemplary implementations, embodiments, and arrangements of the disclosed invention in detail. Those of skill in the art will recognize that there are numerous variations and modifications of this invention that are encompassed by its scope. Accordingly, the description of a certain example embodiment should not be deemed to limit the scope of the present invention.

Implementations of the technology described herein are directed generally to golf club head covers. In some embodiments, an advantage of the covers described herein is that the golfer can store and retrieve golf balls quickly and efficiently. It can also be visually appealing if the golf ball holders look like a character or animal facial feature. For example, the golf ball holders can be made in the shape of eyes. The golf balls can be inserted into the golf ball holders for storage and then the golf ball can be retrieved when needed.

The invention generally relates to a golf club head cover with golf ball holders attached to the outside. The golf ball holders can be created in the form animal or character facial features such as eyes, hair, or a nostril. There are several options for fastening the golf ball holders to the golf club head cover including riveting, sewing, or gluing. The golf balls can be inserted into the golf ball holders and then retrieved when they are necessary. The golf ball holders can also be joined together. For example, two golf ball holders can have joined bases and the tops can work independently. You can manufacture the golf ball holder tops with a tab in the back that can be pushed to open the pivoting top. You can also manufacture the golf ball holder tops with an upturned front lip so as to facilitate the insertion of the golf ball.

Figure 1:
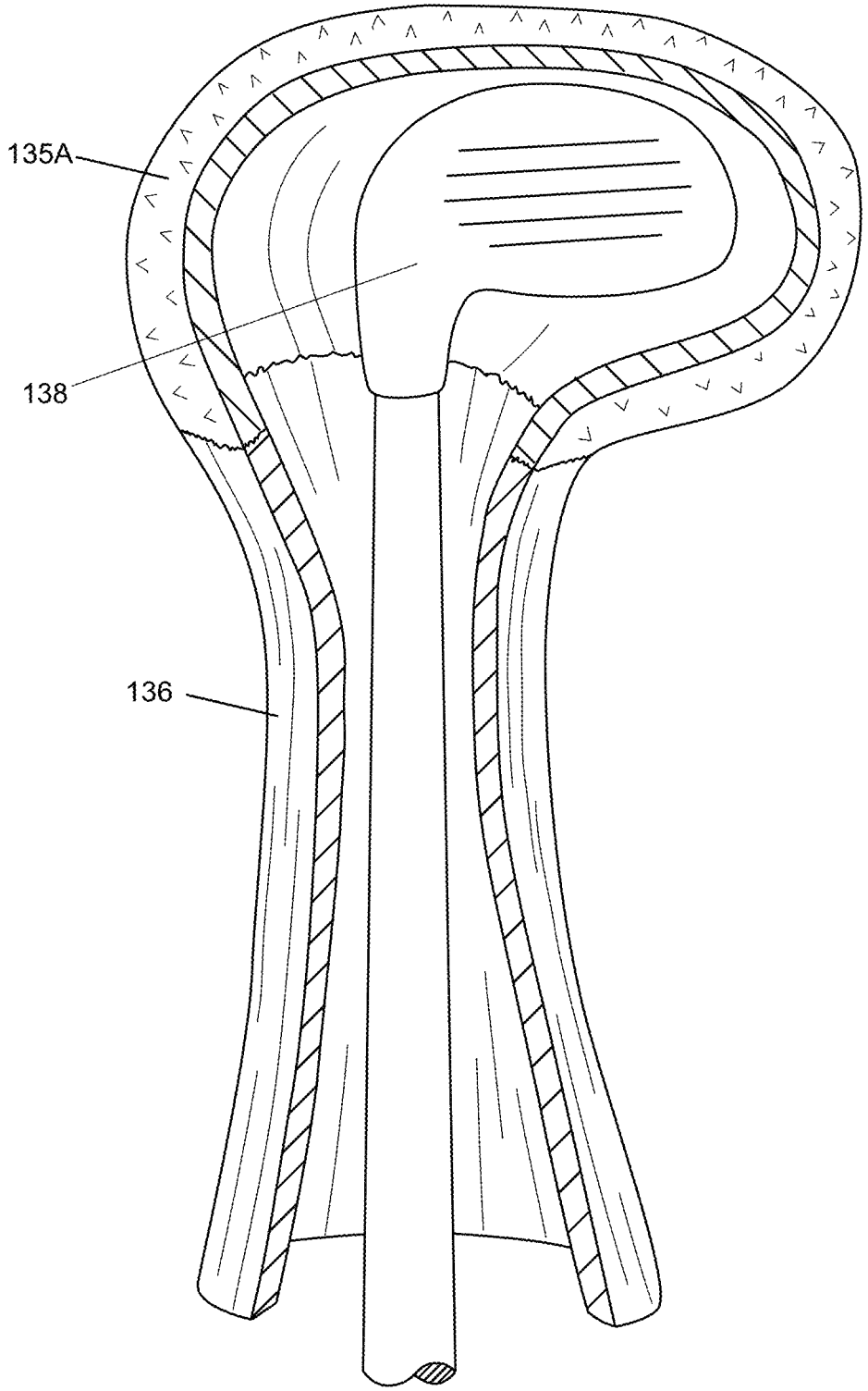
FIG. 1 shows a cross sectional view of a golf club inside a golf club head cover.

FIG. 1 depicts a general view of a typical golf club head cover. The typical golf club head cover has a cushioned top section 135A and stretchable lower section 136. The cushioned top section 135A protects the head of the golf club 138. The stretchable lower section 136 allows the golfer to get the golf club head cover over the golf club head by stretching around the golf club head. The golf club head cover fits snugly over the golf club 138 and should not accidently fall off. Golf club head covers are typically made of various materials including natural textile materials, synthetic textile materials, leather, rubber, and foam.

Figure 2:
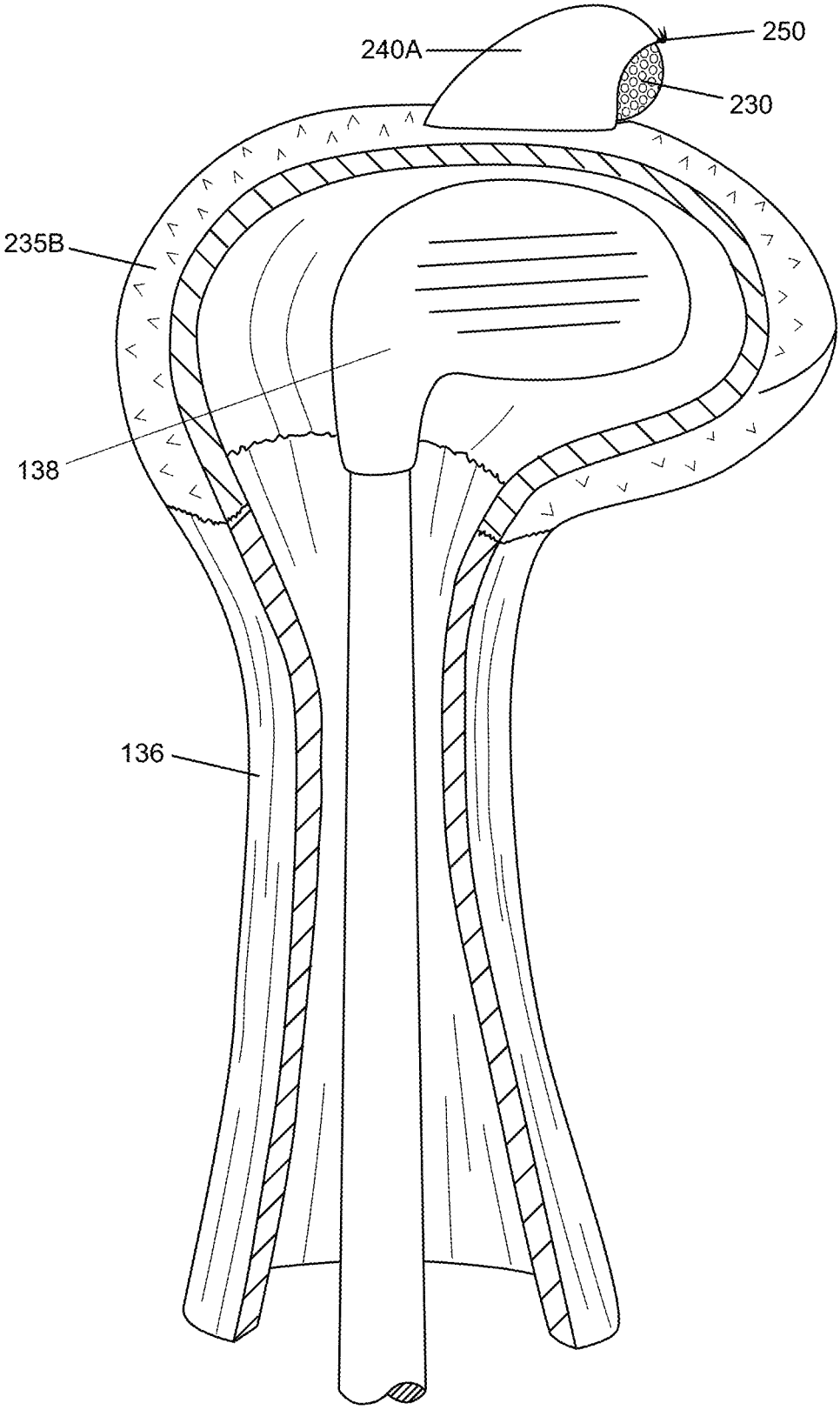
FIG. 2 shows a cross sectional view of a golf club inside a frog shaped golf club head cover with the eye shaped golf ball holder attached to the outside.
Figure 3:
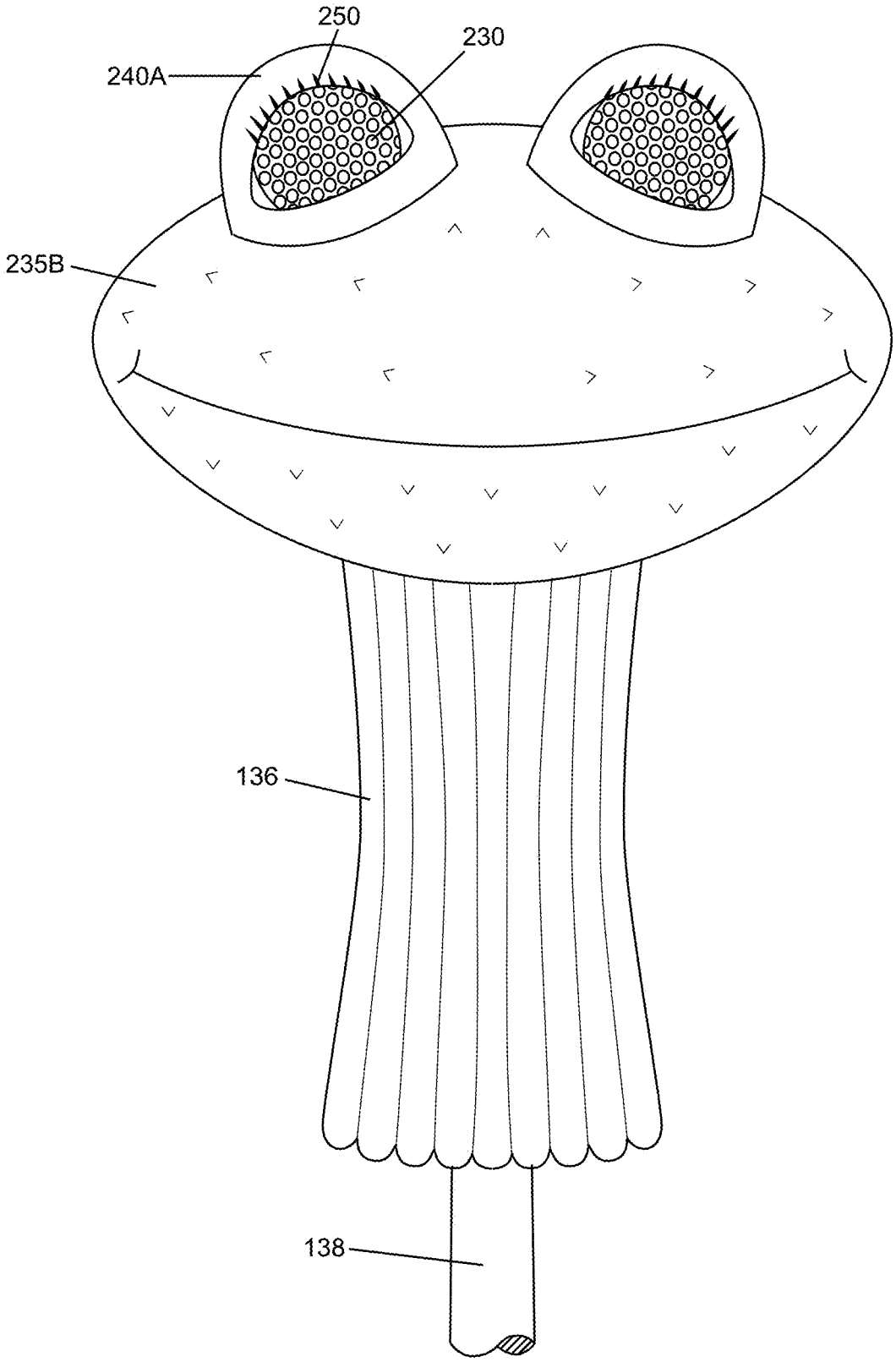
FIG. 3 shows a front view of a frog shaped golf club head cover with eye shaped golf ball holders attached to the outside.
Figure 4:
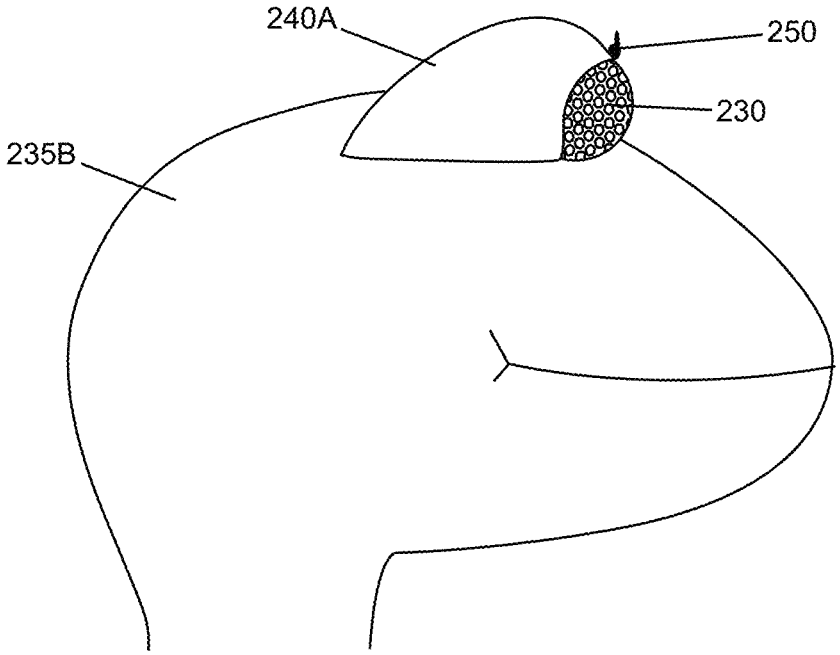
FIG. 4 shows a side view of a frog shaped golf club head cover with a golf ball stored in the golf ball holder.

FIGS. 2, 3 and 4 depict one-piece golf ball holders 240A attached to the outside of a frog shaped golf club head cover 235B. The golf ball holders 240A can be fastened to the golf club head cover 235B with a rivet, glue, or sewn on. 240A can be made of a flexible material, such as plastic, rubber or polyurethane, but a stiffer rubber is advantageous. In this embodiment, the golf ball holders 240A represent the eyes of the frog shaped golf club head cover 235B. An optional material can be added over the golf ball holders 240A to enhance the eye shape. Eyelashes 250 can also be added. The golf club head cover can be made to represent different animals or characters. The golf ball holders can be made to represent different character facial features such as eyes, hair, or nostrils. The golf ball 230 is pushed in to the golf ball holder 240A and can be removed when needed.

It is one advantageous aspect of some embodiments that the golf ball holder holds the golf ball without completely surrounding it, such that the golf ball is visible to the golfer when stored in the golf ball holder. This allows the golfer to easily see if golf balls are available in the golf ball holders without opening a pouch or other golf ball container attached to the bag. This feature is also useful for the favorable aesthetic appearance of the golf club head cover because this feature allows the golf balls themselves part of the animal, character, or the like, such as eyes, nostrils, or any other sculptural aspects of the golf club head cover.

Figure 5:
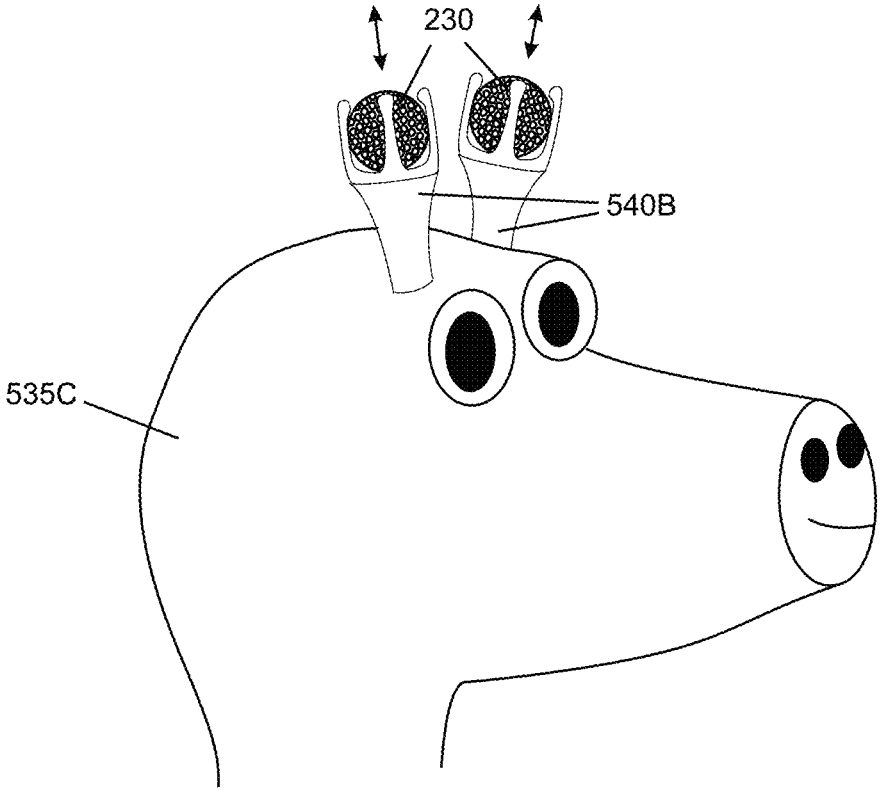
FIG. 5 shows a giraffe shaped golf club head cover with ossicone shaped golf ball holders attached to the outside.

FIG. 5 depicts one-piece golf ball holders 540B that are shaped like giraffe ossicones. The golf ball holders are attached to the outside of a giraffe shaped golf club head cover 535C. The golf ball holders 540B can be fastened to the golf ball head cover 535C with a rivet, glue, or sewn on. 540B can be made of a polyurethane, plastic, rubber, or metal, but plastic is preferred. The golf ball 230 is pushed in to the golf ball holder 540B and can be removed when needed.

Figure 6:
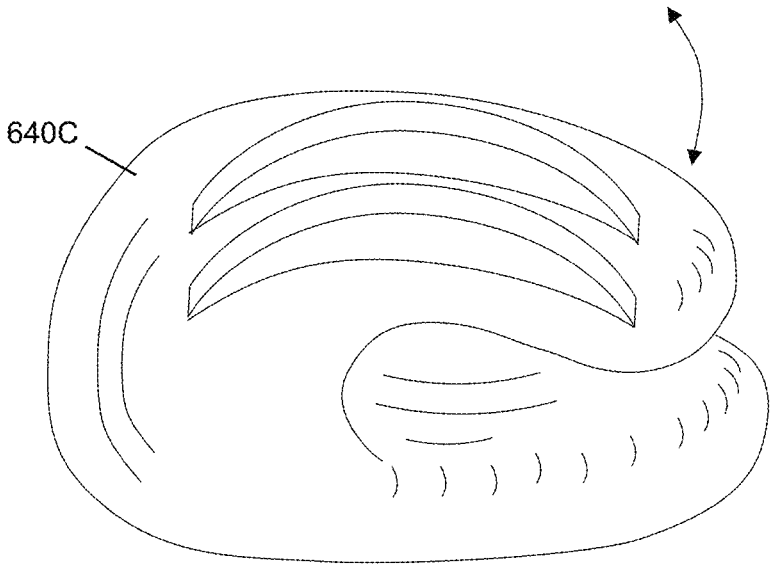
FIG. 6 shows a golf ball holder made of flexible material with ribs that influence a closed position.

FIG. 6 depicts a one-piece golf ball holder 640C made of a flexible material such as polyurethane, flexible plastic, or rubber, but a smooth rubber is preferred. The golf ball holder has ribs that influence a closed position. The golf ball holder 640C grips the ball when a ball is inserted and achieves a closed position when a ball is removed. The golf ball 230 is pushed in to the golf ball holder 640C and can be removed when needed. An optional cover can be added over the golf ball holders 640C to enhance the eye shape. The golf ball holders 640C can be fastened to the golf ball head cover with a rivet, glue, or sewn on, but rivet is preferred.

Figure 7:
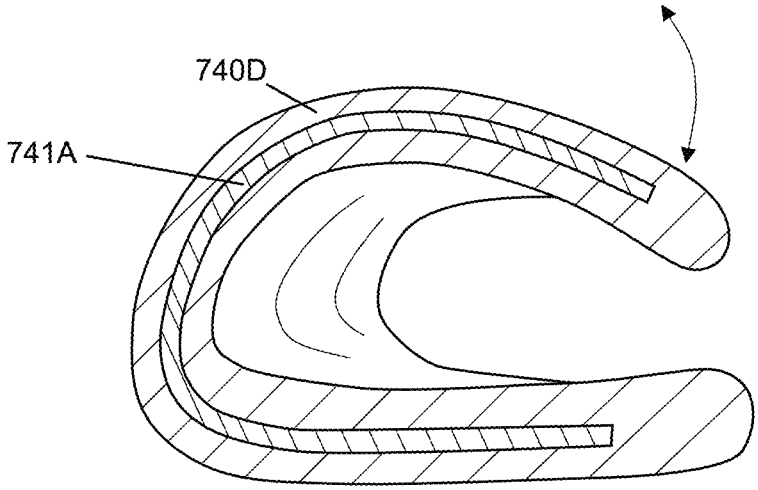
FIG. 7 shows a cross sectional view of a golf ball holder made of an outer flexible material with an inner spring-back material to influence a closed position.

FIG. 7 depicts a golf ball holder made out of a flexible outer material 740D and an inner spring-back material 741A to influence a closed position. The golf ball 230 is pushed in to the golf ball holder and can be removed when needed. 740D can be made of polyurethane, flexible plastic, or rubber. The spring-back material 741A influences a closed position to grip the ball when a ball is inserted and a more closed position when a ball is removed. 741A can be made of high carbon steel to encourage spring-back motion similar to a flat spring. An optional cover can be added over the golf ball holders to enhance the eye shape. The golf ball holders can be fastened to the golf ball head cover with a rivet, glue, or sewn on but a rivet is preferred.

Figure 8:
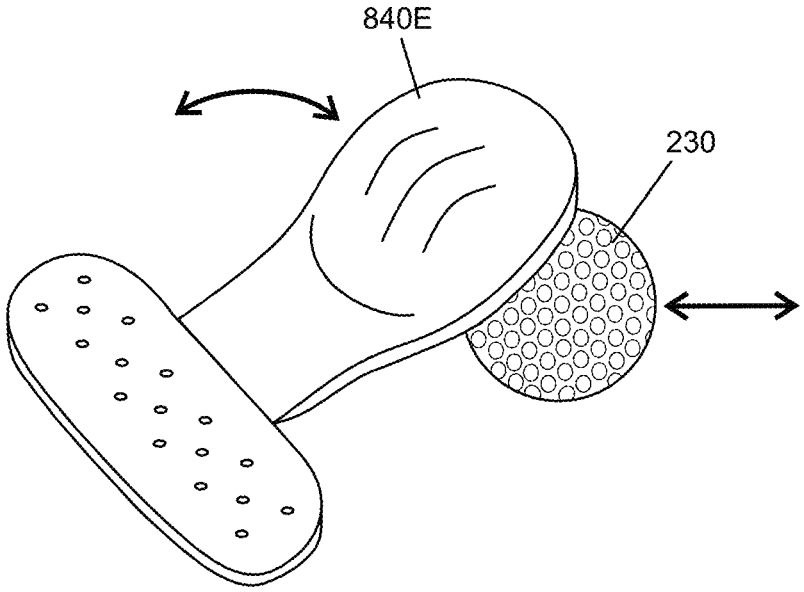
FIG. 8 shows a one-part golf ball holder that allows the top part to rotate around a pivot point.

FIG. 8 depicts a golf ball holder 840E that has a pivoting top. The base portion is intended to be fastened to the golf club head cover 235B and the top portion is used to hold the golf ball. The golf ball holders 840E can be fastened to the golf ball head cover with a rivet, glue, or sewn on. 840E can be made of polyurethane, plastic, or rubber, but plastic is preferred. An optional material can be used to cover the golf ball holder 840E. Elastic material can be added to influence a closed position by pulling the pivoting top to the golf club head cover. The elastic material would be attached from the golf club head cover 235B to the golf ball holder 840E or to the optional golf ball holder cover. A view of the elastic material 1690 can be seen in FIG. 16. The golf ball 230 is pushed in to the golf ball holder and can be removed when needed.

Figure 9:
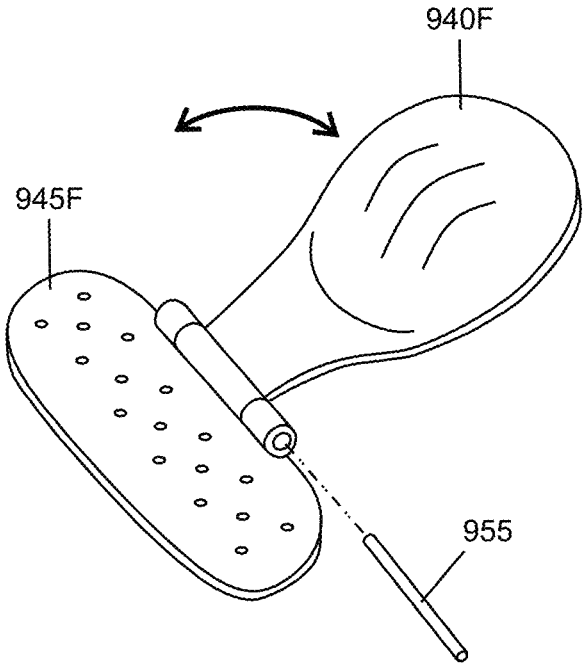
FIG. 9 shows a two-part golf ball holder that allows the top part to rotate around a pivot point.

FIG. 9 depicts a golf ball holder structure comprising of a base 945F and a pivoting top 940F. A connecting pin 955 can be used to attach the pivoting top 940F to the base 945F. The base 945F is intended to be fastened to the golf club head cover 235B and the top 940F is used to hold the golf ball. The back part of the golf ball holders base 945F can be fastened to the golf ball head cover with a rivet, glue, or sewn on. 940F and 945F can be made of polyurethane, plastic, rubber, or metal, but plastic is preferred. An optional material can be used to cover the golf ball holder structure. Elastic material 1690 can be added to influence a closed position by pulling the pivoting top to the golf club head cover. The elastic material would be attached from the golf club head cover 235B to the golf ball holder top 945F or to the optional golf ball holder cover. A view of the elastic material can be seen in FIG. 16. The golf ball 230 is pushed in to the golf ball holder and can be removed when needed.

Figure 10:
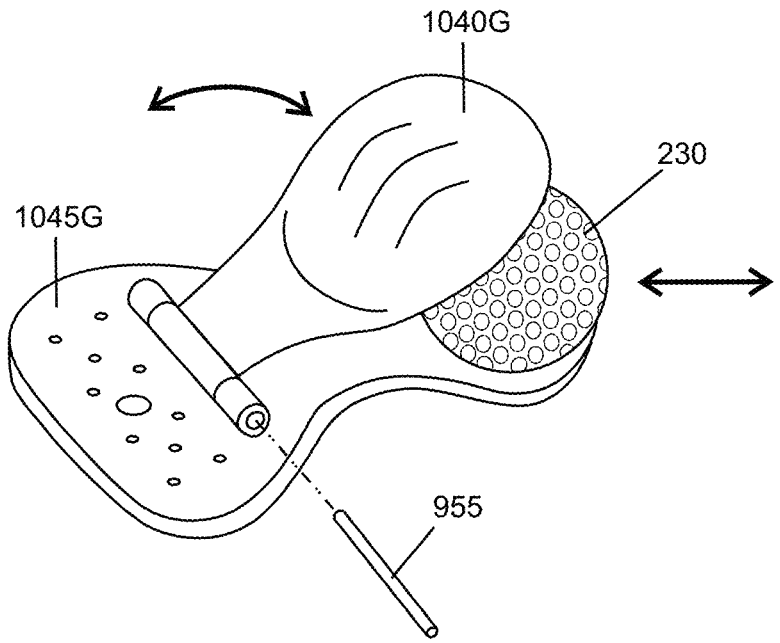
FIG. 10 shows a two-part golf ball holder that includes a base part and a pivoting top part.

FIG. 10 depicts a golf ball holder structure comprising of a base 1045G and a pivoting top 1040G. A connecting pin 955 can be used to attach the pivoting top 1040G to the base 1045G. The base 1045G is intended to be fastened to the golf club head cover 235B. 1045G and 1040G can be made of polyurethane, plastic, rubber, or metal, but plastic is preferred. The top 1040G is used to hold the golf ball. An optional material can be used to cover the golf ball holder structure. An elastic material 1690 can be added to influence a closed position by pulling the pivoting top to the golf club head cover. The elastic material 1690 would be attached from the golf club head cover 235B to the golf ball holder top 1040G or to the optional golf ball holder cover. A view of the elastic material can be seen in FIG. 16. The golf ball 230 is pushed in to the golf ball holder and can be removed when needed.

Figure 11:
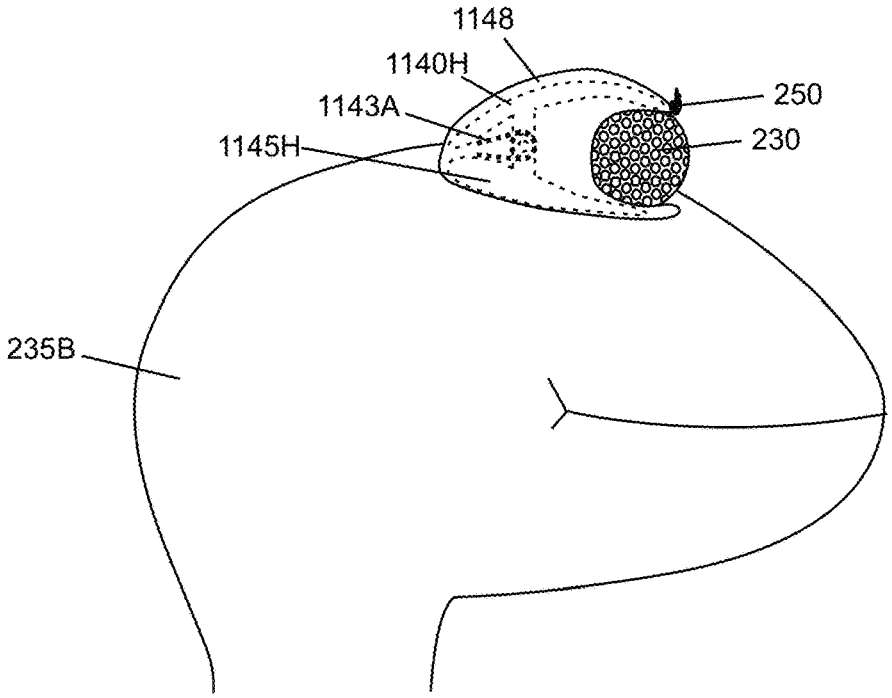
FIG. 11 shows a multi-part golf ball holder comprising a base part and a pivoting top part with a spring that influences a closed position with a golf ball inserted.
Figure 12:
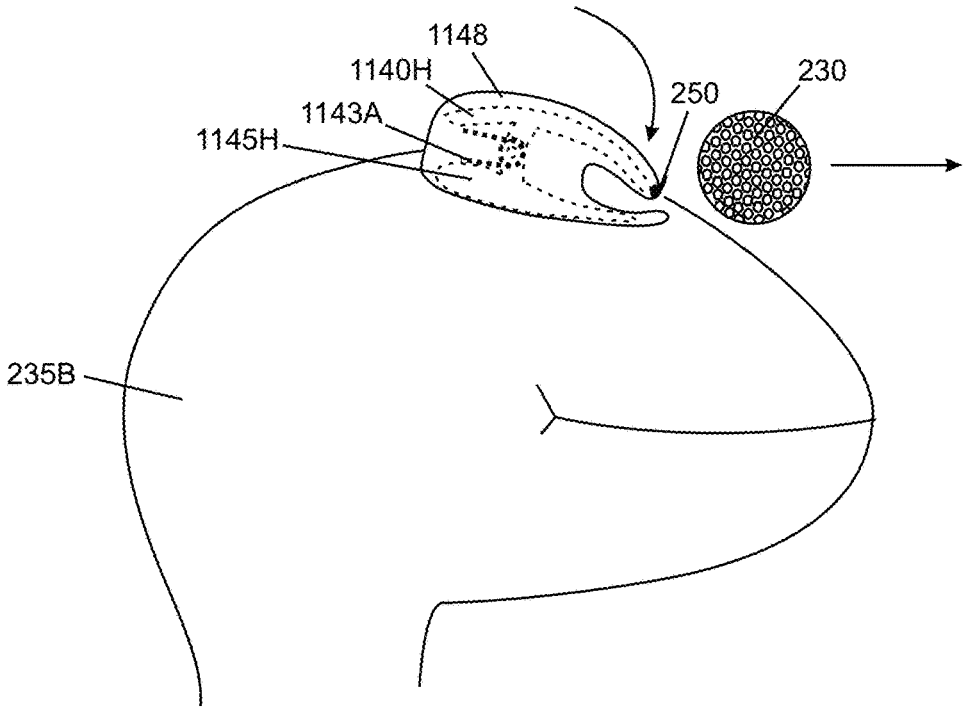
FIG. 12 shows a multi-part golf ball holder comprising a base part and a pivoting top part with a spring that influences a closed position with the golf ball removed.
Figure 13:
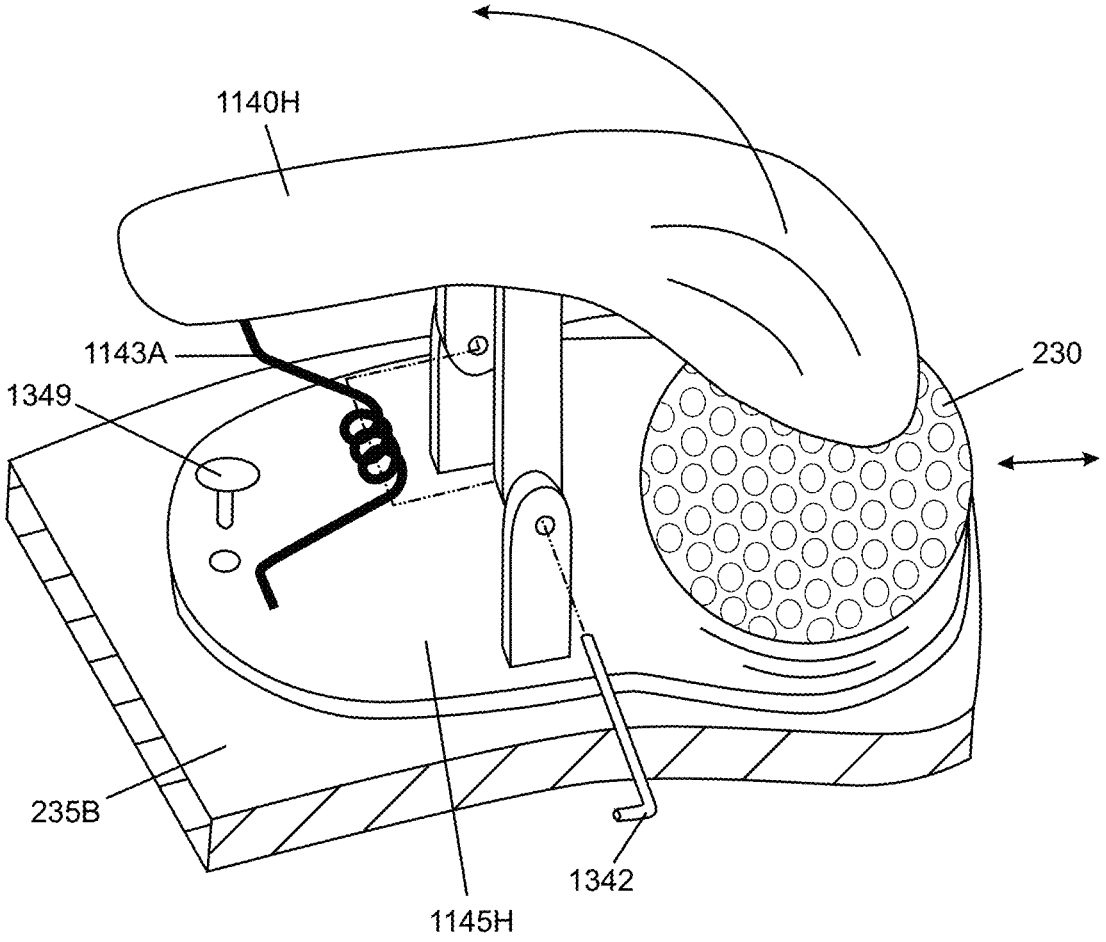
FIG. 13 shows an assembly of a multi-part golf ball holder comprising a base part and a pivoting top part with a spring that influences a closed position.

FIGS. 11, 12 and 13 depict a multi-part golf ball holder structure. The base 1145H is intended to be fastened to the golf club head cover 235B. A rivet 1349 can be used to fasten the base 1145H to the golf club head cover 235B. The golf ball holder structures can be fastened to the golf ball head cover 235B with a rivet, glue, or sewn on, but rivets are preferred. The pivoting top 1140H is connected to the base 1145H using a rod 1342. The rod 1342 holds a spring 1143A in place. The spring 1143A pushes on the pivoting top 1140H and influences a closed position. 1145H and 1140H can be made of polyurethane, plastic, rubber, or metal, but plastic is preferred. An optional cover 1148 can be used to cover the golf ball holder structure. The golf ball 230 is pushed in to the golf ball holder and can be removed when needed. FIG. 11 shows the golf ball holder structure with a golf ball 230 inserted. FIG. 12 shows the golf ball holder structure in the closed position with a golf ball 230 removed.

Figure 14:
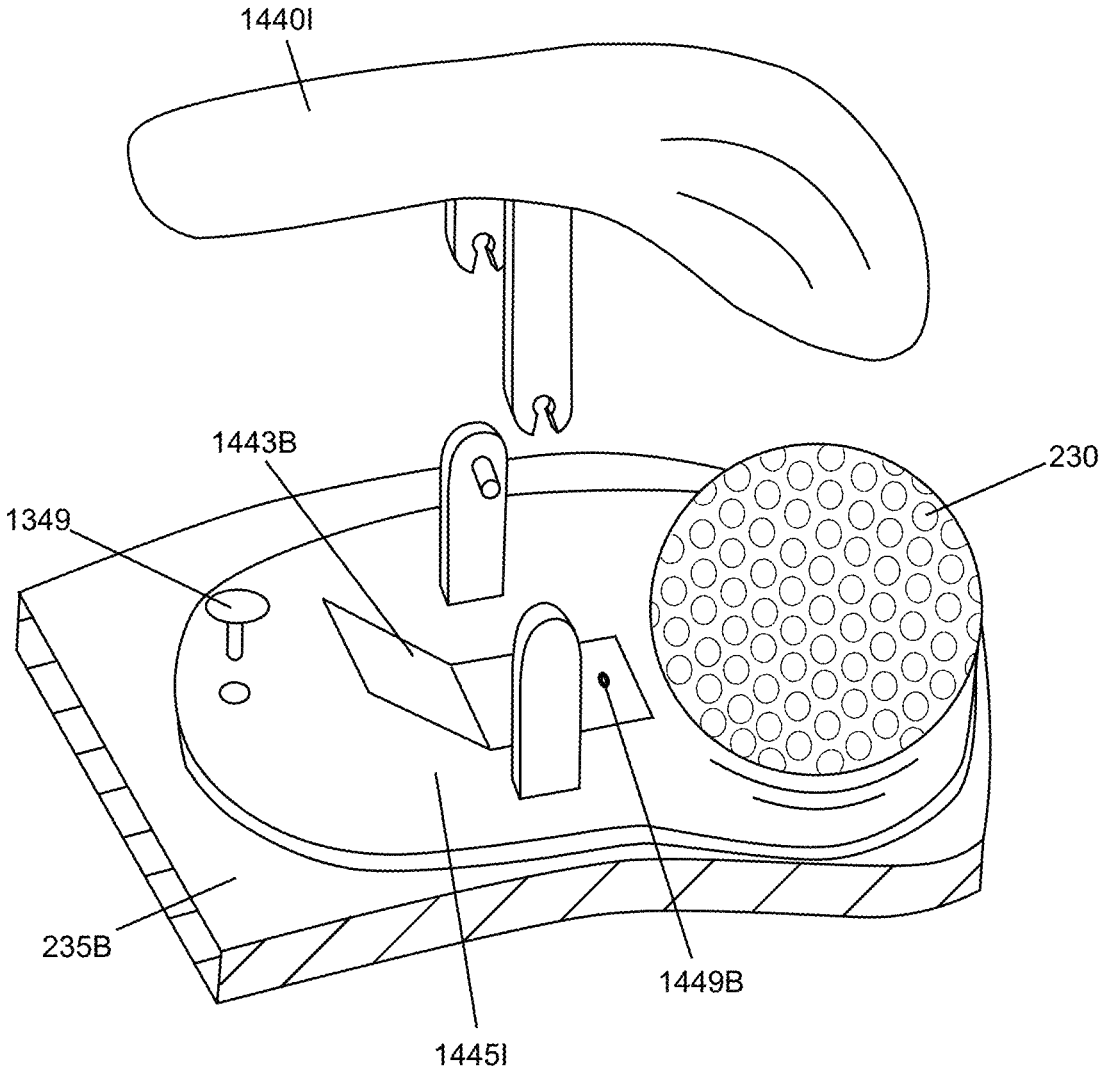
FIG. 14 shows an assembly of a multi-part snap together golf ball holder comprising a base part and a pivoting top part with a plate spring that influences a closed position.

FIG. 14 depicts a golf ball holder structure. The base 14451 is intended to be fastened to the golf club head cover 235B. A rivet 1349 can be used to fasten the base 14451 to the golf club head cover 235B. The golf ball holder structures can be fastened to the golf ball head cover 235B with a rivet, glue, or sewn on but rivets are preferred. The pivoting top 14401 is connected to the base 14451 using one variation of a snap-on method. 14451 and 14401 can be made of polyurethane, plastic, rubber, or metal, but plastic is preferred. The plate spring 1443B is attached to the base 14451 using a plate rivet 1449B. The plate spring 1443B pushes on the pivoting top 14401 and influences a closed position. An optional cover 1148 can be used to cover the golf ball holder structure. The golf ball 230 is pushed in to the golf ball holder and can be removed when needed.

Figure 15:
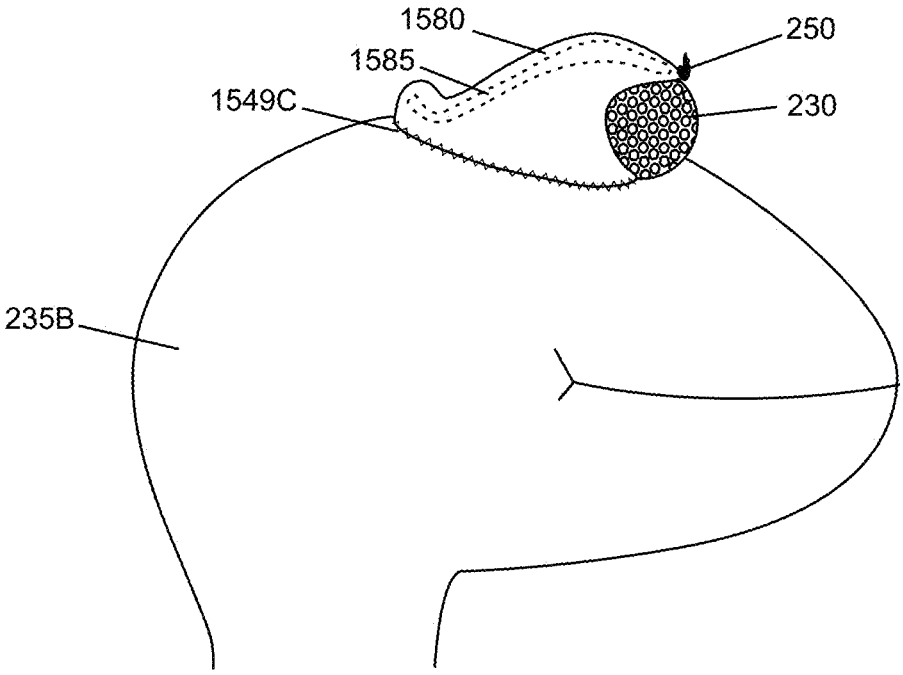
FIG. 15 shows a golf ball holder comprising of a golf-ball-holding material that covers the golf ball and a stiffener part.

FIG. 15 depicts a golf club head cover with a simple golf ball holder. A golf-ball-holding cover 1580 is fastened to the golf club head cover 235B using thread 1549C. A stiffening material 1585 is used to support and shape the golf-ball-holding cover 1580. 1585 can be made of polyurethane, plastic, rubber, or metal, but a harder rubber is preferred. An adhesive can be used to glue the golf-ball-holding cover 1580 to the stiffening material 1585. The golf-ball-holding cover 1580 can also be shaped and stiffened using starch or a fabric stiffener. The golf ball 230 is pushed in to the golf ball holder and can be removed when needed.

Figure 16:
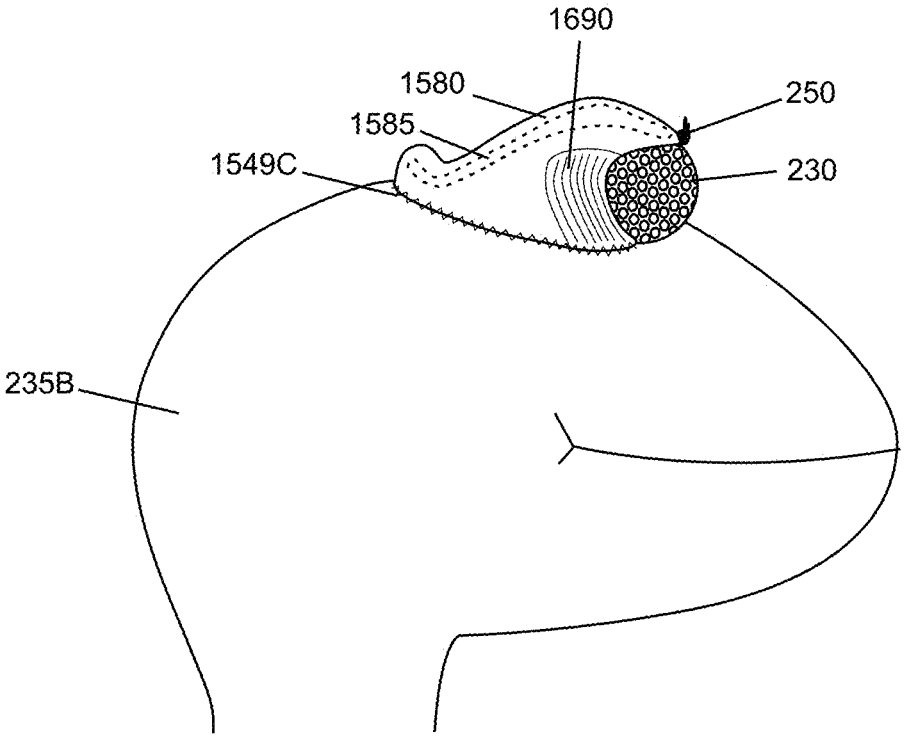
FIG. 16 shows a golf ball holder comprising of a golf-ball-holding material that covers the golf ball and a stiffener part and an elastic material that influences a closed position.

FIG. 16 depicts a golf club head cover with a simple golf ball holder. A golf-ball-holding cover 1580 is fastened to the golf club head cover 235B using thread 1549C. A stiffening material 1585 is used to support and shape the golf-ball-holding cover 1580. 1585 can be made of polyurethane, plastic, rubber, or metal, but a harder rubber is preferred. An adhesive can be used to glue the golf-ball-holding cover 1580 to the stiffening material 1585. The golf-ball-holding cover 1580 can also be shaped and stiffened using starch or a fabric stiffener. An elastic material 1690 is used to close the golf ball holder by pulling the golf ball holder to the golf club head cover. The golf ball 230 is pushed in to the golf ball holder and can be removed when needed.

Figure 17:
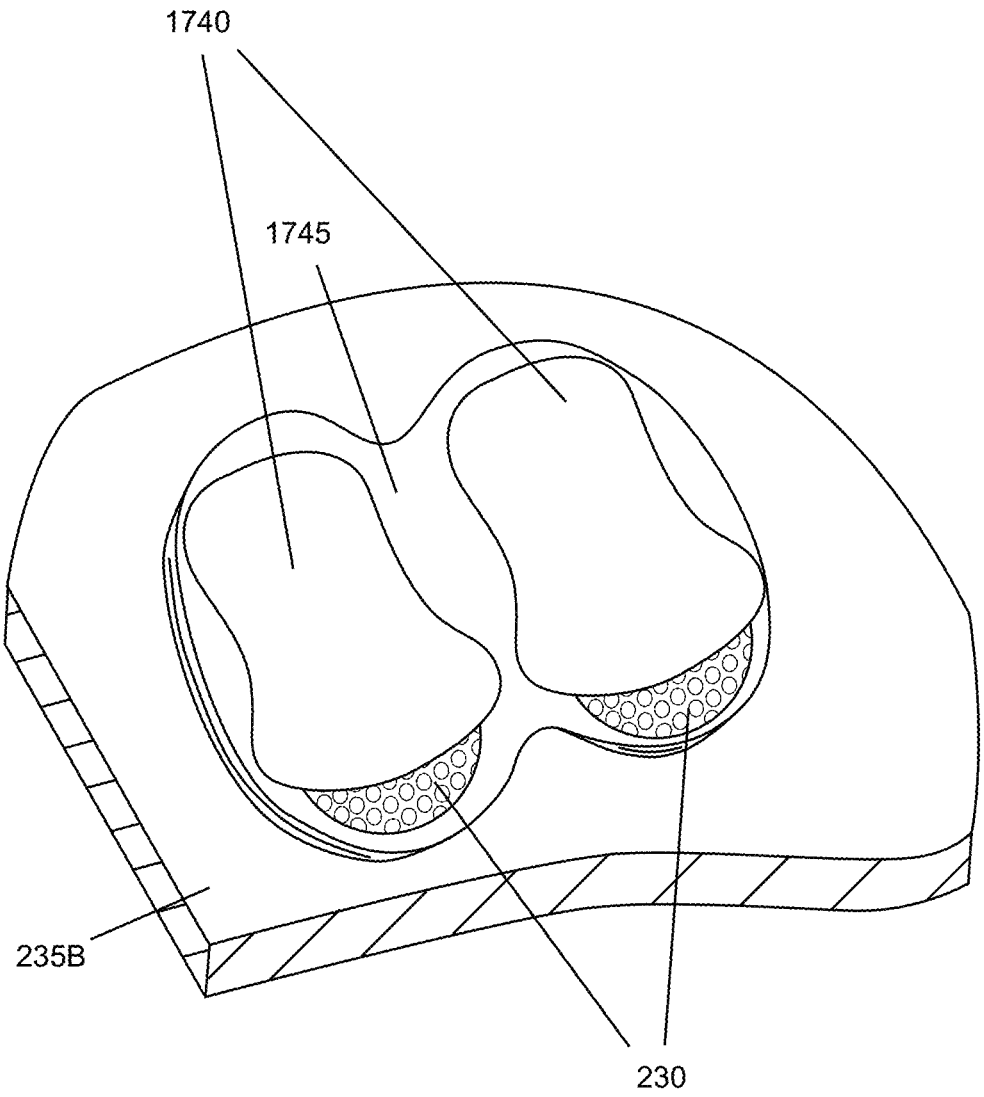
FIG. 17 shows golf ball holders joined at the base.

FIG. 17 depicts a dual golf ball holding base 1745 attached to the outside of the golf club head cover 235B. The base 1745 can be fastened to the golf ball head cover 235B with a rivet, glue, or sewn on, but rivets are preferred. The golf ball holder tops 1740 can also be joined. 1740 and 1745 can be made of polyurethane, plastic, rubber, or metal, but plastic is preferred. Multiple golf ball holders can be joined together to save on manufacturing costs. The golf ball holders can still work independently. The golf ball 230 is pushed in to the golf ball holder and can be removed when needed.

Figure 18:
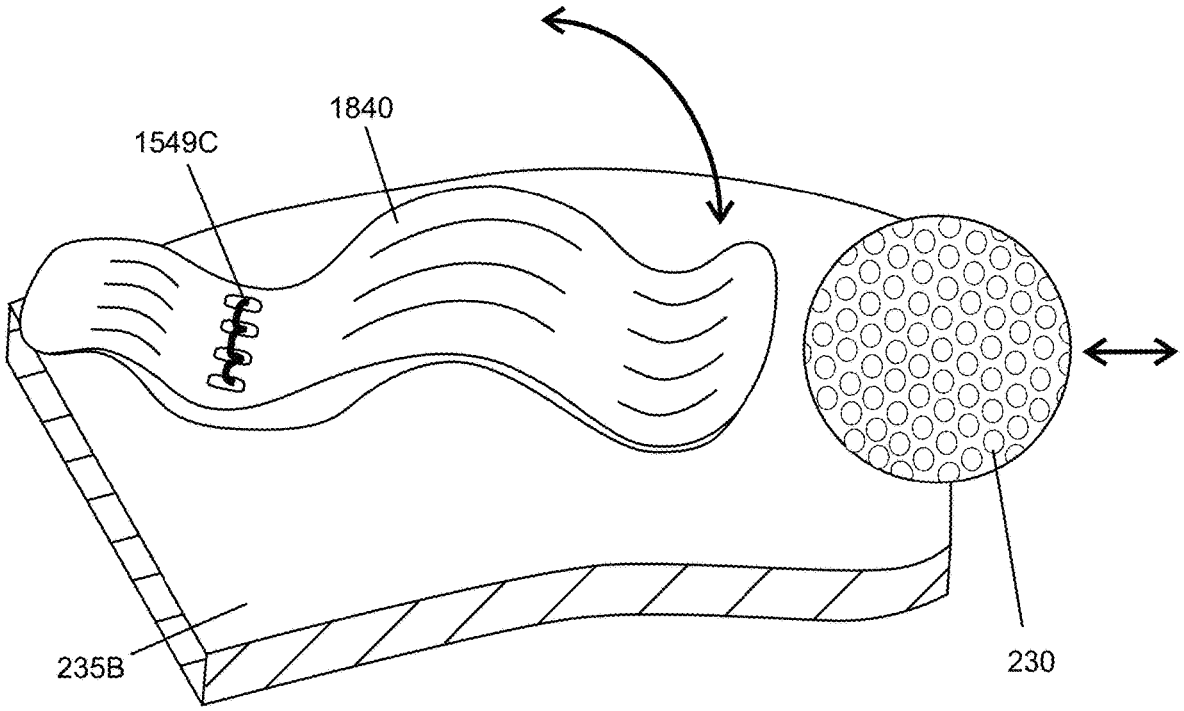
FIG. 18 shows a pivoting golf ball holder with a tab in the back and an upturned front lip.

FIG. 18 depicts a pivoting golf ball holder with a tab in the back and an upturned front lip. A pivoting golf ball holder 1840 is fastened to the golf club head cover 235B using thread 1549C. 1840 can be made of polyurethane, metal, rubber, but a plastic is preferred. An optional cover 1148 can be used to cover the golf ball holder structure. An elastic material 1690 can be used to close the golf ball holder by pulling the optional golf ball holder cover to the golf club head cover. The elastic material 1690 would be attached from the golf club head cover 235B to the golf ball holder 1840 or to the optional golf ball holder cover. This embodiment shows a tab in the back that can be pushed to open. This embodiment shows an upturned front lip so as to facilitate the insertion of the golf ball. You can push the tab in the back to open the pivoting golf ball holder top. The golf ball 230 is pushed into the golf ball holder and can be removed when needed.

Figure 19:
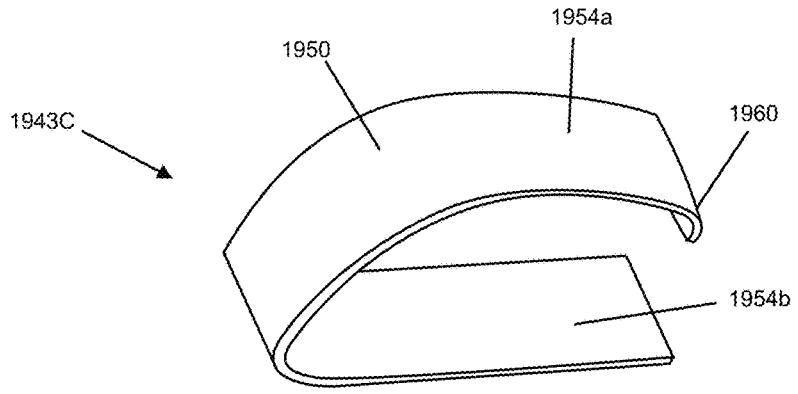
FIG. 19 shows a clamp spring.

FIG. 19 depicts a clamp spring 1943C that can be used to influence a closed position. A clamp spring may have a generally c-shaped body 1950 with two resiliently coupled arms 1954*a* and 1954*b*. The arms have an unstressed configuration where their ends are separated by a resting distance. A deformation force is applied to either open the arms further or close the arms further. When the deformation force is removed, the arms return to the unstressed configuration. One or both of the arms may include a lip 1960 for attaching the clamp spring to the desired structure or item.

Figure 20:
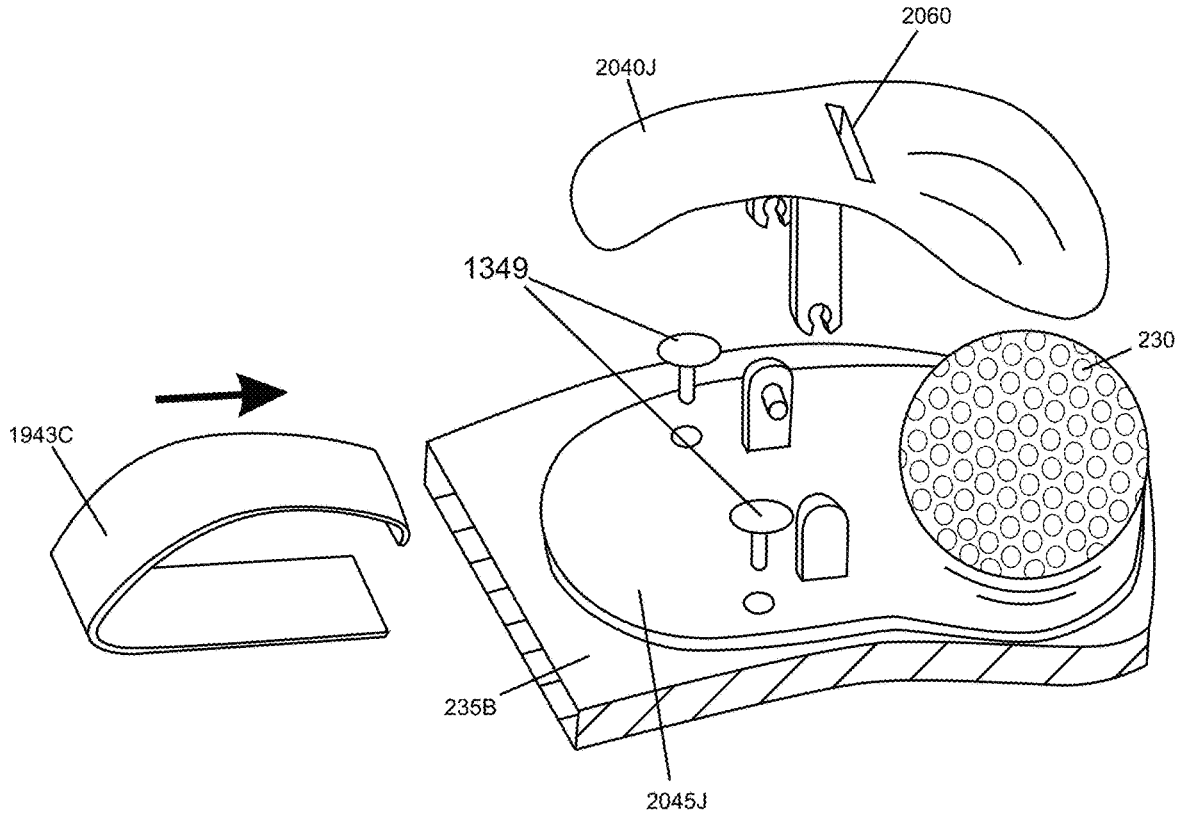
FIG. 20 shows a golf ball holder assembly using a clamp spring

FIG. 20 depicts a golf ball holder structure using a clamp spring 1943C. The base 2045J is intended to be fastened to the golf club head cover 235B. A rivet 1349 can be used to fasten the base 2045J to the golf club head cover 235B. The golf ball holder structures can be fastened to the golf ball head cover 235B with a rivet, glue, or sewn on but rivets or sewn are preferred. The pivoting top 2040J is connected to the base 2045J using one variation of a snap-on method. 2045J and 2040J can be made of polyurethane, plastic, rubber, or metal, but plastic is preferred. The lower arm 1954*b* of FIG. 19 is placed under the base between the base and the golf club head cover. The upper arm 1954*a* extends up the back around the outside of the pivoting top, with the lip engaged with a slot 2060 in the top 2040J The resting position of the clamp spring 1943C is configured such that it biases the top 2040J toward the base, keeping the holder closed when no golf ball is present. To place a golf ball in the holder, the top is pushed up to force the clamp spring open. After the a golf ball is installed, the user releases the clamp spring and clamp spring tension caused by the separation of the clamp spring arms around the golf ball pushes the top of the golf ball down, securing it against the base. The clamp spring can be made of durable spring metal or flexible spring-like plastic. An optional cover 1148 can be used to cover the golf ball holder structure. The golf ball 230 is pushed in to the golf ball holder and can be removed when needed.

Any of the embodiments can be used to store golf balls. The embodiment shown in the FIGS. 11, 12, 13 and 20 can provide a very stable golf ball holder that closes reliably. The embodiment may have five individual pieces. It should be understood that the invention is not limited to the embodiments shown in FIGS. 11, 12, 13 and 20. The embodiment shown in FIG. 2 would only require one piece and lower manufacturing costs. The FIG. 2 embodiment would not close when the ball is removed.

General Interpretive Principles for the Present Disclosure

Various aspects of the novel systems, apparatuses, and methods are described more fully hereinafter with reference to the accompanying drawings. The teachings disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the novel systems, apparatuses, and methods disclosed herein, whether implemented independently of or combined with any other aspect of the disclosure. For example, a system or an apparatus may be implemented, or a method may be practiced using any one or more of the aspects set forth herein. In addition, the scope of the disclosure is intended to cover such a system, apparatus or method which is practiced using other structure, functionality, or structure and functionality in addition to or other than the various aspects of the disclosure set forth herein. It should be understood that any aspect disclosed herein may be set forth in one or more elements of a claim. Although some benefits and advantages of the preferred aspects are mentioned, the scope of the disclosure is not intended to be limited to particular benefits, uses, or objectives. The detailed description and drawings are merely illustrative of the disclosure rather than limiting, the scope of the disclosure being defined by the appended claims and equivalents thereof.

With respect to the use of plural vs. singular terms herein, those having skill in the art can translate from the plural to the singular and/or from the singular to the plural as is appropriate to the context and/or application. The various singular/plural permutations may be expressly set forth herein for sake of clarity.

When describing an absolute value of a characteristic or property of a thing or act described herein, the terms "substantial," "substantially," "essentially," "approximately," and/or other terms or phrases of degree may be used without the specific recitation of a numerical range. When applied to a characteristic or property of a thing or act described herein, these terms refer to a range of the characteristic or property that is consistent with providing a desired function associated with that characteristic or property.

In those cases where a single numerical value is given for a characteristic or property, it is intended to be interpreted as at least covering deviations of that value within one significant digit of the numerical value given.

If a numerical value or range of numerical values is provided to define a characteristic or property of a thing or act described herein, whether or not the value or range is qualified with a term of degree, a specific method of measuring the characteristic or property may be defined herein as well. In the event no specific method of measuring the characteristic or property is defined herein, and there are different generally accepted methods of measurement for the characteristic or property, then the measurement method should be interpreted as the method of measurement that would most likely be adopted by one of ordinary skill in the art given the description and context of the characteristic or property. In the further event there is more than one method of measurement that is equally likely to be adopted by one of ordinary skill in the art to measure the characteristic or property, the value or range of values should be interpreted as being met regardless of which method of measurement is chosen.

It will be understood by those within the art that terms used herein, and especially in the appended claims (e.g., bodies of the appended claims) are intended as "open" terms unless specifically indicated otherwise (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

In those instances where a convention analogous to "at least one of A, B, and C" is used, such a construction would include systems that have A alone, B alone, C alone, A and B together without C, A and C together without B, B and C together without A, as well as A, B, and C together. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include A without B, B without A, as well as A and B together."

Various modifications to the implementations described in this disclosure can be readily apparent to those skilled in the art, and generic principles defined herein can be applied to other implementations without departing from the spirit or scope of this disclosure. Thus, the disclosure is not intended to be limited to the implementations shown herein but is to be accorded the widest scope consistent with the claims, the principles and the novel features disclosed herein. The word "exemplary" is used exclusively herein to mean "serving as an example, instance, or illustration." Any implementation described herein as "exemplary" is not necessarily to be construed as preferred or advantageous over other implementations.

Certain features that are described in this specification in the context of separate implementations also can be implemented in combination in a single implementation. Conversely, various features that are described in the context of a single implementation also can be implemented in multiple implementations separately or in any suitable sub-combination. Moreover, although features can be described above as acting in certain combinations and even initially claimed as such, one or more features from a claimed combination can in some cases be excised from the combination, and the claimed combination can be directed to a sub-combination or variation of a sub-combination.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

COMPONENT REFERENCE NUMERALS

135A—cushioned golf club head cover material
136—stretchable golf club head cover material
138—golf club
230—golf ball
235B—frog shaped golf club head cover
240A—golf ball holder
250—eyelashes
535C—giraffe shaped golf club head cover
540B—ossicone golf ball holders
640C—flexible and ribbed self-closing golf ball holder
740D—outer flexible golf ball holder material
741A—spring-back embedded insert
840E—one piece golf ball holder top
940F—simple pivoting golf ball holder top
945F—simple golf ball holder base
955—connecting pin
1040G—two-piece pivoting golf ball holder top
1045G—two-piece golf ball holder base
1140H—multi-piece pivoting golf ball holder top
1143A—spring
1145H—multi-piece golf ball holder base
1148—golf ball holder cover
1342—spring rod
1349—rivet fastener
1449B=plate attaching rivet
14401—snap-in multi-piece pivoting golf ball holder top
1443B—plate spring
14451—snap-in multi-piece golf ball holder base
1549C—thread fastener
1580—golf-ball-holding material
1585—stiffener
1690—elastic material
1740—golf ball holder tops that attach to a joined base
1745—dual golf ball holding base
1840—pivoting golf ball holder with a tab in the back and an upturned front lip
1943C—Clamp spring used to close golf ball holder
2040J—Pivoting golf ball holder top for a clamp spring
2045J—Golf ball holder base for a clamp spring

What is claimed is:

1. A golf club head cover comprising:

golf club head cover materials configured to cover a golf club head;

one or more golf ball holders, wherein each of the one or more golf ball holders comprises (1) a base for supporting the golf ball, wherein the base is attached to the golf club head cover materials and (2) a top coupled to the base with a pivotal connection;

wherein the golf club head cover materials are shaped in the form of an animal or character head;

wherein the base of each of the one or more golf ball holders are attached with one or more fasteners to the golf club head cover materials such that the top extends from an outer facing surface of the golf club head cover materials above a mouth and forms an anatomical feature of the animal or character head; and wherein the top pivots with respect to the base between an open configuration and a closed configuration, wherein in the open configuration a front portion of the top and a front portion of the base are pivotally separated to hold a golf ball therebetween with the pivotal connection adjacent to the golf ball, and wherein in the closed configuration the front portion of the top and the front portion of the base are substantially adjacent to each other; wherein an exposed surface portion of the golf ball forms an eyeball feature of the animal or character head when positioned between the top and the base adjacent to the pivotal connection, and wherein the top forms an eyelid feature of the animal or character head that is pivoted closed with respect to the base when no golf ball is positioned between the top and the base.

2. The golf club head cover of claim 1, further comprising a spring that biases the top toward the base to hold a golf ball therein.

3. The golf club head cover of claim 2, wherein the spring is a clamp spring.

4. The golf club head cover of claim 3, wherein the clamp spring clamps around the base and the top to bias the top downward toward the base.

5. The golf club head cover of claim 1, wherein said fasteners used to attach said one or more golf ball holders to said golf club head cover materials comprise one or more of rivets, thread or glue.

6. The golf club head cover of claim 1, further comprising covers positioned over said one or more golf ball holders.

7. The golf club head cover of claim 1, further comprising an elastic material that pulls the one or more golf ball holders closed.

8. The golf club head cover of claim 1, wherein said one or more golf ball holders are joined together.

* * * * *